US008662256B2

(12) United States Patent
Asano

(10) Patent No.: US 8,662,256 B2
(45) Date of Patent: Mar. 4, 2014

(54) ELEVATOR CONTROL APPARATUS WITH CAR STOP DESTINATION FLOOR REGISTRATION DEVICE

(75) Inventor: Norimasa Asano, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 347 days.

(21) Appl. No.: 13/027,547

(22) Filed: Feb. 15, 2011

(65) Prior Publication Data

US 2011/0220437 A1 Sep. 15, 2011

(30) Foreign Application Priority Data

Mar. 15, 2010 (JP) ..... 2010-058158

(51) Int. Cl.
*B66B 1/16* (2006.01)

(52) U.S. Cl.
USPC ..... 187/380; 187/391

(58) Field of Classification Search
USPC ..... 187/247, 248, 380–388, 391–393
See application file for complete search history.

(56) References Cited

U.S. PATENT DOCUMENTS

| | | | | |
|---|---|---|---|---|
| 4,708,224 | A | 11/1987 | Schrooder | |
| 4,878,562 | A | 11/1989 | Schroder | |
| 4,939,634 | A | 7/1990 | Schroder | |
| 5,004,076 | A | 4/1991 | Chen et al. | |
| 5,065,846 | A | 11/1991 | Schroder | |
| 5,490,580 | A * | 2/1996 | Powell et al. | 187/281 |
| 5,780,789 | A * | 7/1998 | Tsuji | 187/382 |
| 6,315,082 | B2 * | 11/2001 | Hikita | 187/382 |
| 7,040,458 | B2 * | 5/2006 | Forsythe et al. | 187/396 |
| 7,387,191 | B2 * | 6/2008 | Kostka et al. | 187/381 |
| 7,431,130 | B2 * | 10/2008 | Hikita et al. | 187/382 |
| 7,823,702 | B2 * | 11/2010 | Hirade | 187/392 |
| 7,849,974 | B2 * | 12/2010 | Stanley et al. | 187/387 |
| 7,975,808 | B2 * | 7/2011 | Smith et al. | 187/382 |
| 8,028,806 | B2 * | 10/2011 | Stanley et al. | 187/387 |
| 8,151,943 | B2 * | 4/2012 | de Groot | 187/382 |
| 8,413,767 | B2 * | 4/2013 | Nakashima | 187/384 |
| 2005/0077114 | A1 | 4/2005 | Kostka et al. | |
| 2008/0073159 | A1 | 3/2008 | Al-Fayez | |

FOREIGN PATENT DOCUMENTS

| | | | |
|---|---|---|---|
| CN | 1032648 | A | 5/1989 |
| CN | 1045748 | A | 10/1990 |
| CN | 1334232 | A | 2/2002 |
| CN | 1605554 | A | 4/2005 |
| CN | 101565139 | A | 10/2009 |
| JP | 07-232867 | A | 9/1995 |
| JP | 09-067070 | A | 3/1997 |

(Continued)

*Primary Examiner* — Anthony Salata
(74) *Attorney, Agent, or Firm* — Foley & Lardner LLP

(57) ABSTRACT

According to one embodiment, a response time calculation unit calculates a response time of each of the cars required when the car stop call is assigned to the car. An assignment control unit assigns the car stop call to the optimum car, based on the response time of each of the cars. A car load calculation unit calculates a load value of each car at the time when each car starts from a registration floor of the car stop call after responding to the call. A boarding possibility determination unit determines, for each car, whether the user can get on the car or not, by comparing the load value with a preset capacity value. A registration control unit performs control to assign the car stop call, including a second and later responses to the registration floor of the car stop call, based on a determination result of the boarding possibility.

9 Claims, 16 Drawing Sheets

(56) References Cited

FOREIGN PATENT DOCUMENTS

| | | | |
|---|---|---|---|
| JP | 2001-287876 | A | 10/2001 |
| JP | 2004-107046 | A | 4/2004 |
| JP | 2007-055782 | A | 3/2007 |
| JP | 2007-191263 | A | 8/2007 |
| JP | 2008-162764 | A | 7/2008 |
| WO | WO 03/026997 | A1 | 4/2003 |

* cited by examiner

21
| Registration floor | Target floor | Assigned car | Special signal | Waiting time |
|---|---|---|---|---|
| 10F | 12F | A | — | — |
| 15F | 10F | C | — | — |
| 10F | 14F | B | — | — |
| | | | | |
| | | | | |
| | | | | |
FIG. 2
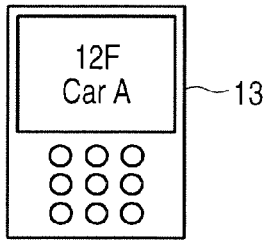
Car stop destination floor registration device
FIG. 3
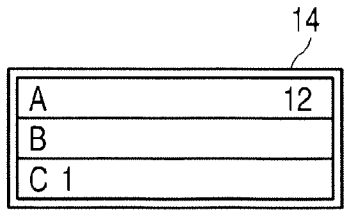
Stopping floor display device
FIG. 4

24

| Floor | Direction | Expected load |
|---|---|---|
| 4 | UP | 360 |
| 5 | UP | 360 |
| 6 | UP | 425 |
| 7 | UP | 240 |
| 8 | UP | 310 |
| 9 | UP | 310 |
| 10 | UP | 195 |
| 11 | UP | 195 |
| 12 | UP | 65 |
| 13 | UP | 0 |
| 14 | UP | 0 |
| 15 | DN | 0 |
| 14 | DN | 65 |
| 13 | DN | 65 |
| 12 | DN | 65 |
| 11 | DN | 65 |
| 10 | DN | 65 |
| 9 | DN | 65 |
| 8 | DN | 65 |
| 7 | DN | 65 |
| 6 | DN | 65 |
| 5 | DN | 65 |
| 4 | DN | 65 |
| 3 | DN | 65 |
| 2 | DN | 0 |
| 1 | UP | 0 |
| 2 | UP | 0 |
| 3 | UP | 0 |
| 4 | UP | 0 |
| 5 | UP | 0 |
| 6 | UP | 0 |

FIG. 5

21a

| Registration floor | Target floor | Assigned car | Special signal | Waiting time |
|---|---|---|---|---|
| 1F | 10F | A | — | — |
| 1F | 2F | B | — | — |
| 1F | 3F | B | — | — |
| 1F | 10F | A | — | — |
| 1F | 6F | B | — | — |
| 1F | 8F | C | — | — |
| 1F | 2F | B | — | — |
| 1F | 6F | B | — | — |
| 1F | 13F | A | — | — |
| 1F | 3F | B | — | — |
| 1F | 3F | B | — | — |
| 1F | 6F | B | — | — |
| 1F | 9F | C | — | — |
| 1F | 6F | B | — | — |
| 1F | 6F | B | — | — |
| 1F | 5F | B | ON | — |

FIG. 14

21a

| Registration floor | Target floor | Assigned car | Special signal | Waiting time |
|---|---|---|---|---|
| 1F | 10F | A | — | — |
| 1F | 10F | B | — | — |
| 1F | 8F | C | — | — |
| 1F | 13F | A | — | — |
| 1F | 9F | C | — | — |
| 1F | 5F | B | ON | — |

FIG. 18

21a

| Registration floor | Target floor | Assigned car | Special signal | Waiting time |
|---|---|---|---|---|
| 1F | 10F | A | — | — |
| 1F | 10F | B | — | — |
| 1F | 8F | C | — | — |
| 1F | 13F | A | — | — |
| 1F | 9F | C | — | — |
| 1F | 5F | B | — | — |

FIG. 19

21a

| Registration floor | Target floor | Assigned car | Special signal | Waiting time |
|---|---|---|---|---|
| 1F | 10F | A | — | — |
| 1F | 2F | B | — | — |
| 1F | 3F | B | — | — |
| 1F | 10F | A | — | — |
| 1F | 6F | B | — | — |
| 1F | 8F | C | — | — |
| 1F | 2F | B | — | — |
| 1F | 6F | B | — | — |
| 1F | 13F | A | — | — |
| 1F | 3F | B | — | — |
| 1F | 3F | B | — | — |
| 1F | 6F | B | — | — |
| 1F | 9F | C | — | — |
| 1F | 6F | B | — | — |
| 1F | 6F | B | — | — |
| 1F | 5F | B | ON | 39 |

FIG. 23

Car stop destination floor registration device

21a

| Registration floor | Target floor | Assigned car | Special signal | Waiting time |
|---|---|---|---|---|
| 1F | 10F | A | — | — |
| 1F | 2F | B | — | — |
| 1F | 3F | B | — | — |
| 1F | 10F | A | — | — |
| 1F | 6F | B | — | — |
| 1F | 8F | C | — | — |
| 1F | 2F | B | — | — |
| 1F | 6F | B | — | — |
| 1F | 13F | A | — | — |
| 1F | 3F | B | — | — |
| 1F | 3F | B | — | — |
| 1F | 6F | B | — | — |
| 1F | 9F | C | — | — |
| 1F | 6F | B | — | — |
| 1F | 6F | B | — | — |
| | | | | |

ELEVATOR CONTROL APPARATUS WITH CAR STOP DESTINATION FLOOR REGISTRATION DEVICE

CROSS-REFERENCE TO RELATED APPLICATIONS

This application is based upon and claims the benefit of priority from Japanese Patent Application No. 2010-058158, filed Mar. 15, 2010; the entire contents of which are incorporated herein by reference.

FIELD

Embodiments described herein relate generally to an elevator control apparatus which includes a car stop destination floor registration device that can register the destination floor at the car stop.

BACKGROUND

Generally, when an elevator is used, the user operates an UP button or a DOWN button installed in the car stop to register a car stop call, gets on the car which responded to the registration floor, and then performs operation to register a car call of a destination floor.

In comparison with this, in elevators which include a device which can register a destination floor at the car stop (which is called "car stop destination floor registration device), the user can register a destination floor in advance at the car stop, it is unnecessary to perform registration operation in the car.

In an elevator system in which a plurality of cars are managed in a group, when a destination floor of the user is registered by operation of the car stop destination floor registration device, a car stop call including the destination floor is assigned to an optimum car among the cars. Such an elevator system may be provided with a system in which a car stop call assignment result for each user is displayed on the car stop destination floor registration device (For example, Jpn. Pat. Appln. KOKAI Publication No. 2001-287876, and Jpn. Pat. Appln. KOKAI Publication No. 2007-191263).

For example, in the case where user A performs a destination floor registration of "1F to 3F", user B performs a destination floor registration of "1F to 7F", user C performs "1F to 20F", and user D performs "1F to 22F", it is displayed that user A should get on car No. 1, user B should get on car No. 4, and user C and user D should get on car No. 2. By such a display, the users can understand which car they should get on after registering their destination floors.

However, for example, in office buildings, there are cases where a specific floor (the main floor) is crowded with many users before the start of office hours. In such cases, although the car stop destination floor registration device displays the number of the car which the users can get on, when the car arrives at the specific floor, there are cases where the car is almost overloaded, and all the waiting users cannot get on the car. Such a situation confuses the users who are waiting at the car stop, and causes the problem that the users who could not get on the car have to register a car stop call again and feel uncomfortable.

Under those circumstances, it is desired to provide an elevator control apparatus which can prevent the users' confusion and efficiently carry the users even when the car stop is crowded, in an elevator which can register car stop calls including destination floors of the users by using a car stop destination floor registration device.

BRIEF DESCRIPTION OF THE DRAWINGS

FIG. 2 is a diagram illustrating a structure of a database provided in a registration control unit in the first embodiment;

FIG. 3 is a diagram illustrating a display example of a car stop destination floor registration device in the first embodiment;

FIG. 4 is a diagram illustrating a display example of a stopping floor display device in the first embodiment;

FIG. 5 is a diagram illustrating a data example stored in a car load calculation unit in the first embodiment;

FIG. 14 is a diagram illustrating a state of the database provided in the registration control unit after a special signal is registered in the first embodiment;

FIG. 18 is a diagram illustrating a state of the database provided in the registration control unit after part of data is erased in the first embodiment;

FIG. 19 is a diagram illustrating a state of the database provided in the registration control unit after the special signal is erased in the first embodiment;

FIG. 23 is a diagram illustrating a state of a database provided in a registration control unit after a waiting time is registered in the second embodiment;

DETAILED DESCRIPTION

According to one embodiment, there is provided an elevator control apparatus equipped with car stop destination floor registration devices that are provided at car stops of floors and can register destination floors of users, and configured to assign a car stop call of a user including a destination floor and registered by operation of one of the car stop destination floor registration devices to an optimum car among plurality of cars. The elevator control apparatus includes a response time calculation unit, an assignment control unit, a car load calculation unit, a boarding possibility determination unit, and a registration control unit. The response time calculation unit calculates a response time of each of the cars required when the car stop call is assigned to the car. The assignment control unit selects the optimum car from the cars and assigns the car stop call to the optimum car, based on the response time of each of the cars calculated by the response time calculation unit. The car load calculation unit calculates a load value of each car at the time when each car starts from a registration floor of the car stop call after responding to the call. The boarding possibility determination unit determines, for each of the cars, whether the user can get on the car or not, by comparing the load value calculated by the car load calculation unit with a preset capacity value. The registration control unit controls the response time calculation unit and the assignment control unit to assign the car stop call, including a second and later responses to the registration floor of the car stop call, based on a determination result of the boarding possibility determination unit.

Various embodiments will be described hereinafter with reference to the accompanying drawings.

First Embodiment

Figure 1:
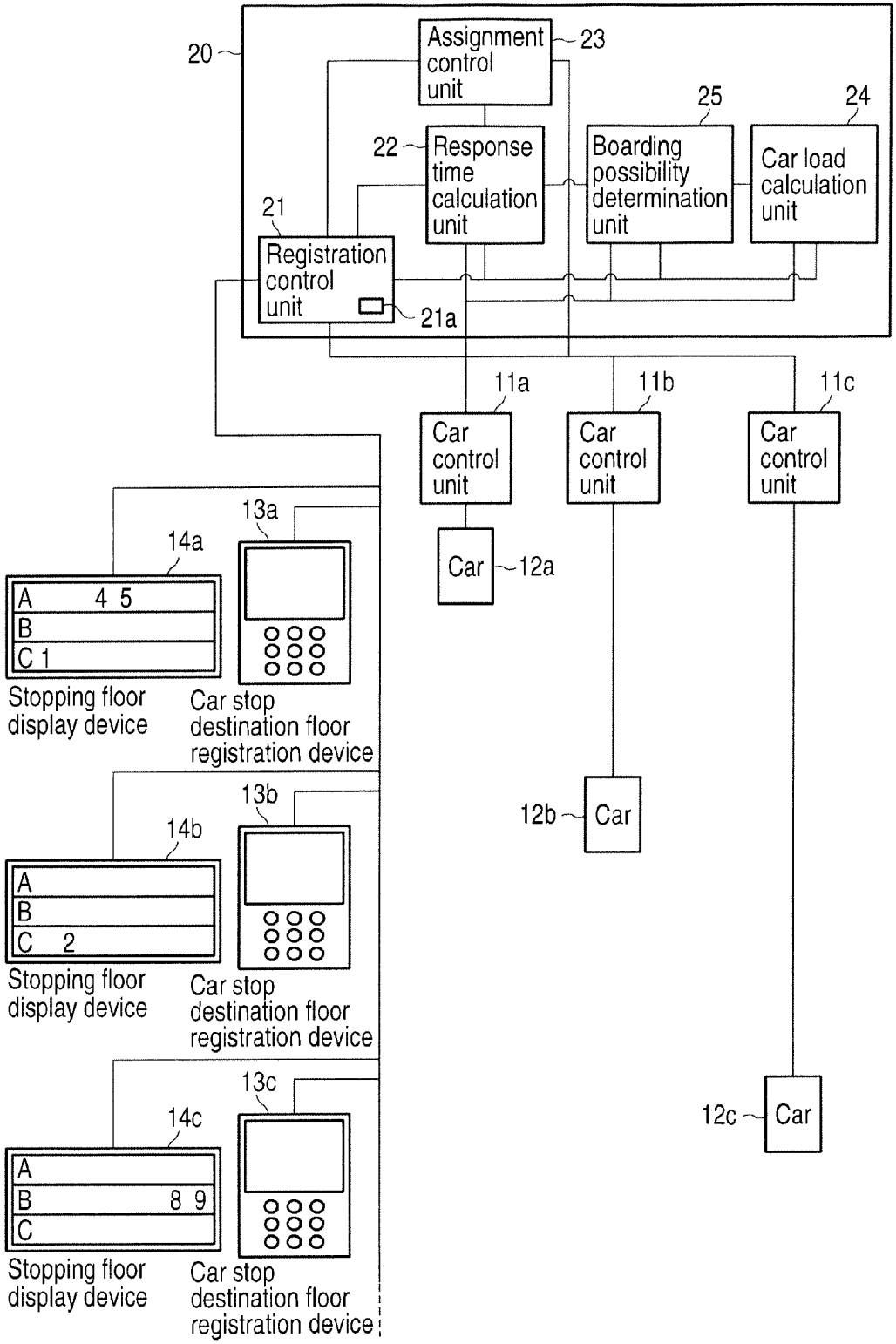
FIG. 1 is a diagram illustrating a configuration of an elevator system according to a first embodiment.

FIG. 1 is a diagram illustrating a configuration of an elevator system according to a first embodiment. Specifically, FIG. 1 illustrates a configuration in which operation of three cars is managed and controlled in a group. When there are a plurality of cars, each car is often referred to as "car . . . ". In addition, simple term "elevator" basically indicates a car.

Car control units 11*a*, 11*b*, and 11*c* are provided for cars 12*a*, 12*b*, and 12*c*, respectively. Each car control unit performs control for the corresponding car, including driving control of a hoisting machine (not shown) and opening/closing control of the door. Each of the cars 12*a*, 12*b*, and 12*c* goes up and down in the elevator shaft by driving a hoisting machine (not shown).

On the other hand, the car stop of each floor is provided with at least one car stop destination floor registration device 13*a*, 13*b*, 13*c*, . . . and at least one stopping floor display device 14*a*, 14*b*, and 14*c*, . . . .

The car stop destination floor registration devices 13*a*, 13*b*, 13*c*, . . . are devices for the user's registering a destination floor at the car stop of each floor, and have an operation unit to register a destination floor, and a display unit to display an assignment result and the like. Although the method of registering a destination floor is generally performed by operating numeric keys, the method may be any method such as using, for example, a card or RFID reader, as long as the destination floor can be registered at the car stop.

Each of the stopping floor display devices 14*a*, 14*b*, 14*c*, . . . is formed of, for example, a liquid crystal display, and displays the floors at which the cars are stopping.

When registration of a destination floor is performed by the car stop destination floor registration devices 13*a*, 13*b*, 13*c*, . . . of the floors, car stop call information formed of a pair of two information items, that is, the destination floor and the calling floor, is output to a group management control unit 20. In the following explanation, the "destination floor" may be referred to as the "target floor", and the "calling floor" may be referred to as the "registration floor".

When the group management control unit 20 receives car stop call information, the group management control unit 20 selects an optimum car to which the car stop call information is to be assigned (which is called "optimum car") among the cars 12*a*, 12*b*, and 12*c*, based on operation information (such as the car position, the traveling direction, and the door opening/closing state) of the cars 12*a*, 12*b*, and 12*c* obtained from the car control units 11*a*, 11*b*, and 11*c*, and assigns the car stop call information to the optimum car.

In the following explanation, the car to which the car stop call information is assigned is referred to as an "assigned car". When the assigned car is determined, the car stop destination floor registration device 13 provided at the registration floor of the car stop call displays the number of the assigned car for a predetermined time.

As the display method, there are a method of displaying a car identifier allocated to the car, and a method of displaying the assigned car by using colors set for the respective cars. In addition, the display method may be a method of using a voice announcement together, and may be any method as long as the user can recognize the assigned car. By such display of the assigned car, the user can understand which car to get on.

Simultaneously with this, stopping floor information formed of a pair of assigned car information and destination floor information is output from the group management control unit 20 to the stopping floor display device 14 provided at the same registration floor. The stopping floor display device 14 displays the floors at which the cars are stopping, based on the stopping floor information. Thereby, the user can recognize the car which is going to stop at the destination floor that the user has registered.

The group management control unit 20 is a device which manages and controls operations of the cars 12*a*, 12*b*, and 12*c* in a group. In the first embodiment, the group management control unit 20 includes a registration control unit 21, a response time calculation unit 22, an assignment control unit 23, a car load calculation unit 24, and a boarding possibility determination unit 25. These are processing units which are executed by software on a microprocessor, and can exchange information between them as illustrated in FIG. 1.

Although all the registration control unit 21, the response time calculation unit 22, the assignment control unit 23, the car load calculation unit 24, and the boarding possibility determination unit 25 are arranged in the group management control unit 21 in this example for convenience, all the units are not necessarily arranged in the same unit, but may be arranged in different units.

The registration control unit 21 has a database 21*a* as illustrated in FIG. 2, and registers car stop call information items registered by the car stop destination floor registration devices 13*a*, 13*b*, and 13*c*, . . . of the respective floors, and assigned car information items output from the assignment control unit 23. As described above, each car stop call information item includes two information items, that is, the destination floor (target floor) and the calling floor (registration floor). The special signal and the waiting time which are shown in FIG. 2 will be explained later.

In the example of FIG. 2, the following three information items are registered in the database 21*a*. These information items are erased when a response by the assigned car is finished:

(1) The 12th floor is registered by the car stop destination floor registration device 13 provided at the 10th floor, and the call is assigned to car A;

(2) The 10th floor is registered by the car stop destination floor registration device 13 provided at the 15th floor, and the call is assigned to car C; and (3) The 14th floor is registered by the car stop destination floor registration device 13 provided at the 10th floor, and the call is assigned to car B.

The registration control unit 21 outputs these registration information items to the car stop destination floor registration devices 13 and the stopping floor display devices 14. For example, when "the 12th floor is registered by the car stop destination floor registration device 13 provided at the 10th floor, and the call is assigned to car A", the registration control unit 21 outputs assigned car information (car A) to the car stop destination floor registration device 13 provided at the 10th floor, as illustrated in FIG. 3. In addition, as illustrated in FIG. 4, the registration control unit 21 outputs assigned car information (car A) and target floor information (12th floor) to the stopping floor display device 14 provided at the 10th floor.

In addition, when the assigned car responds to the car stop call, the target floor information is output to the corresponding car control unit 11 among the car control units 11*a*, 11*b*, and 11*c*. Thereby, the car call is automatically registered in the car 12 through the car control unit 11. For example, when the target floor information (12th floor) is output, a car call of going to the 12th floor is automatically registered in the car 12.

The response time calculation unit 22 calculates a response time for each car, which is used as an index of assignment, for a car stop call which is newly registered in the registration control unit 21. The response time is calculated based on assignment information items of already registered car stop calls, car call information items, the current car positions, the traveling directions, and the door opening/closing states.

In the first embodiment, the time (service time) required from the user's registering a car stop call until the car arrives at the target floor is used as the "response time". Specifically, as the response time used for assignment control, the response time calculation unit 22 calculates the time which is obtained by adding the first time required until the car arrives at the registration floor of the car stop call to the second time required until the car arrives at the destination floor (target floor) registered by the user from the registration floor. The method of calculating the response time will be detailed later with specific examples.

The assignment control unit 23 calculates, for each of the cars 12*a*, 12*b*, and 12*c*, an evaluated value which indicates the optimum for a car stop call newly registered in the registration control unit 21, based on the expected response time calculated by the response time calculation unit 22, and outputs assignment of the car stop call. In this processing, the assignment control unit 23 outputs assigned car information, which indicates to which car the car stop call is assigned, to the registration control unit 21.

The car load calculation unit 24 calculates, for each of the cars 12*a*, 12*b*, and 12*c*, the number of people getting on and off the car at each floor, based on the current load, the current traveling information, and the information items registered in the registration control unit 21, and calculates the load of each car at the time when the car starts for the registration floor in response to the car stop call of the registration floor.

In this example, suppose that the car load is calculated on the assumption that the load per person is 65 kg. In systems using IC tags which register personal information (personal load information), or systems which perform load measurement when the user registers a destination floor, the car load may be calculated by using individual load information items.

When the load per person is uniformly set at 65 kg, there is a difference from the actually-measured load, and thus it is necessary to correct the value to prevent the difference from increasing. For example, when the number of passengers in the car is 6 and the actually-measured load is 360 kg, the expected load is "65 kg×6 people=390 kg", and there is a difference of 30 kg between the actual load and the expected load.

Therefore, the load per person after the users get on the car is calculated from the actually-measured load. Specifically, when there are six passengers in the car, the load per person is calculated by "360 kg÷6 people=60 kg".

The method of calculating the load is explained with a specific example.

Suppose that the current information (referred to as "information X") relating to car A is as follows:

Number of floors of building=15 floors

Current car load of car A=360 kg

Current position of car A=4th floor

Current direction of car A=up

Number of passengers in car A=6

Floors at which passengers in car A are getting off=7th (2 people), 8th (1 person), and 10th (3 people)

Information items registered in the registration control unit 21:

(1) 7th floor is registered by the car stop destination floor registration device 13 provided at the 6th floor, and the call is assigned to car A;

(2) 12th floor is registered by the car stop destination floor registration device 13 provided at the 8th floor, and the call is assigned to car A;

(3) 13th floor is registered by the car stop destination floor registration device 13 provided at the 8th floor, and the call is assigned to car A;

(4) 12th floor is registered by the car stop destination floor registration device 13 provided at the 10th floor, and the call is assigned to car A; and (5) 2nd floor is registered by the car stop destination floor registration device 13 provided at the 14th floor, and the call is assigned to car A.

In the above case, car A is now traveling at the 4th floor in the upward direction, and the next stopping floor thereof is the 6th floor. Therefore, the load value from the 4th floor to the 5th floor is 360 kg. Since there are 6 passengers in car A, the load per person of the passengers in the car is calculated as "360 kg÷6 people=60 kg". On the other hand, the load of the user which is going to get on car A is calculated as 65 kg which is a default value.

4th floor, and 5th floor (UP)=360 kg

Since one user gets on the car at the 6th floor in this state, the expected load is:

6th floor (UP)=360 kg+65 kg=425 kg

Next, since three users get off the car at the 7th floor, the expected load is:

7th floor (UP)=425 kg−(65 kg+60 kg×2 people)=240 kg

At the eighth floor, since one user gets off the car, and two users get on the car, the expected load is:

8th floor (UP)=240 kg−60 kg+(65 kg×2 people)=310 kg

Since the car does not stop at the 9th floor, the expected load is maintained at 310 kg. Since three users get off the car and one user gets on the car at the 10th floor, the expected load is:

10th floor (UP)=310 kg−(60 kg×3 people)+65 kg=195 kg

Since the car does not stop at the 11th floor, the expected load is maintained at 195 kg. Since two users get off the car at the 12th floor, the expected load is:

12th floor (UP)=195 kg−(65 kg×2 people)=65 kg

Since one user gets off the car at the 13th floor, the expected load is:

13th floor (UP)=65 kg−65 kg=0 kg

Since the traveling direction of car A is reversed at the 14th floor, the expected load is:

14th floor (UP), and 15th floor (DOWN)=0 kg

After the direction of car A is reversed to the downward direction, since one user gets on the car at the 14th floor, the expected load is:

14th floor (DOWN)=65 kg

Since the car does not stop from 13th floor to 3rd floor, the expected load is maintained at 65 kg.

13th floor (DOWN) to 3rd floor (DOWN)=65 kg

Since one user gets off the car at the 2nd floor, the expected load is:

2nd floor (DOWN)=65 kg−65 kg=0 kg

After the car arrives at the 2nd floor, no car stop call is registered at the present time, and thus the expected load is maintained at zero. These results are put into a table, and the table is stored in the car load calculation unit 24. FIG. 5 illustrates an example of stored data.

The car load is recalculated each time when the car starts from each floor, and only the newest data is stored in a storing section (not shown) of the car load calculation unit 24.

The boarding possibility determination unit 25 determines whether the user can get on each car or not, for a car stop call which is newly registered in the registration control unit 21.

For example, suppose that the expected load value of car A is as illustrated in FIG. 5, and the preset capacity set value thereof is 450 kg.

When a newly registered call (registration floor: 6th floor, target floor: 10th floor) is registered, the expected load when the car starts from the 6th floor is "425 kg+65 kg=490 kg", and exceeds the capacity set value (450 kg). As a result, the boarding possibility determination unit 25 outputs a signal indicating that the user cannot get on the car to the response time calculation unit 22.

Generally, the response time calculation unit 22 calculates the time required until the car arrives at the floor at which a new car stop call is registered first while the car responds to the already registered call, as the first time. However, when the boarding possibility determination unit 25 determines that the user cannot get on the car, the response time calculation unit 22 calculates, as the first time, the time required until the car arrives at the car stop call registration floor for the second time, not the time required until the car arrives at the car stop call registration floor for the first time.

In this processing, the response time calculation unit 22 calculates a response time which is obtained by adding a second time required until the user actually arrives at the target floor by getting on the car to the first time. The time obtained by adding the second time to the first time is referred to as the "service time".

Figure 6:
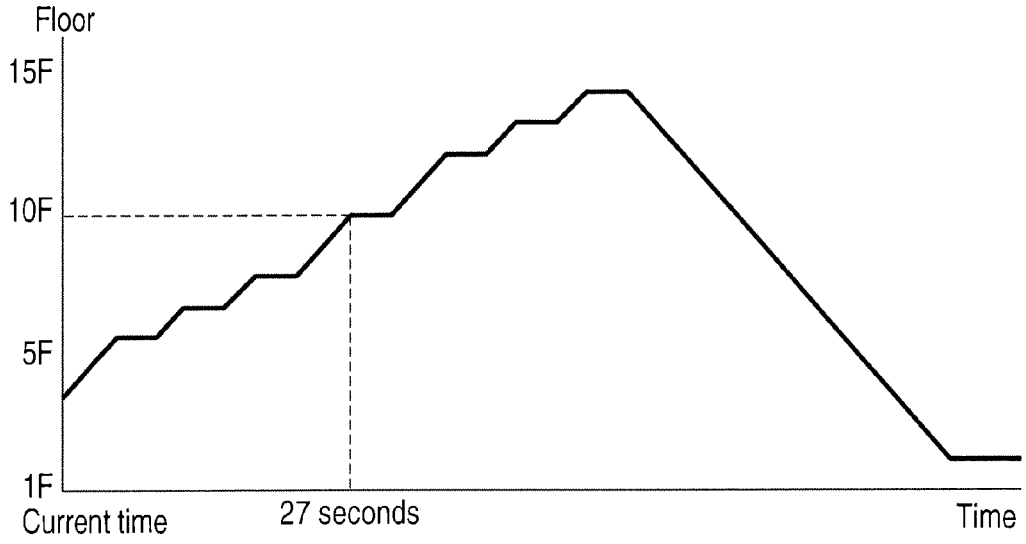
FIG. 6 is a diagram illustrating an example of an expected traveling curve of car A in the first embodiment (in the case where the user can get on the car at a first response)

The service time is calculated by using an expected traveling curve. For example, information relating to car A is the above information X, the expected traveling curve of car A is as illustrated in FIG. 6.

When the capacity set value is 600 kg, the boarding possibility determination unit 25 determines that the user can get on the car for a newly registered call (registration floor: 6th floor, target floor: 10th floor), and the response time calculation unit 22 calculates the time required until the car arrives at the 10th floor for the first time as the service time, as usual. In this case, based on the expected traveling curve illustrated in FIG. 6, the response time calculation unit 22 calculates the service time as follows:

Service time for newly registered call=27 seconds

Figure 7:
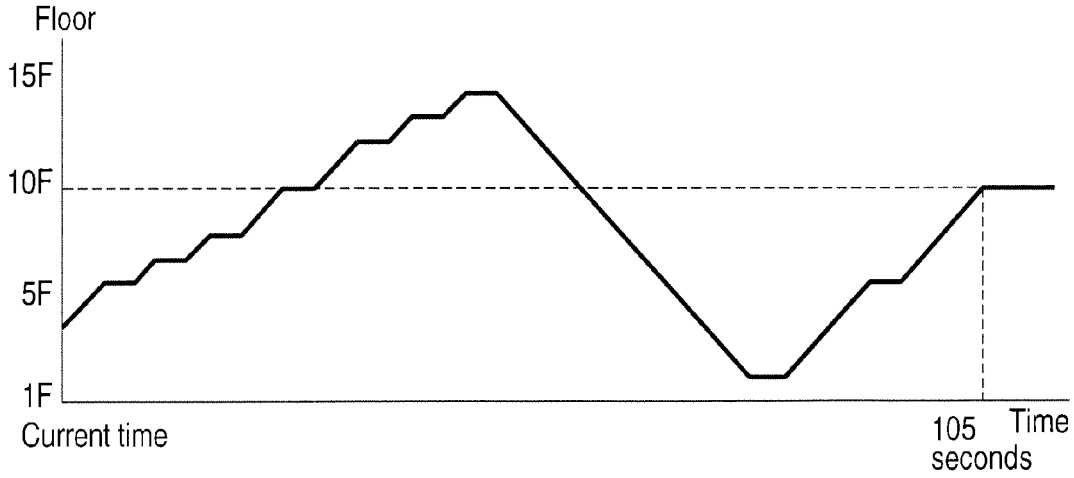
FIG. 7 is a diagram illustrating an example of an expected traveling curve of car A in the first embodiment (in the case where the user cannot get on the car at the first response)

On the other hand, when the capacity set value is 450 kg, the boarding possibility determination unit 25 determines that the user cannot get on the car. In this case, the boarding possibility determination unit 25 calculates the service time to the 10th floor, supposing that the user does not get on car A when car A arrives at the 6th floor for the first time, but gets on car A when car A arrives at the 6th floor for the second time. The expected traveling curve based on this movement is as illustrated in FIG. 7, and the service time is calculated as follows:

Service time for newly registered call=105 seconds

Next, explained is the case where the assignment control unit 23 selects the car which the boarding possibility determination unit 25 determines that the user cannot get on, as the optimum car.

Figure 8:
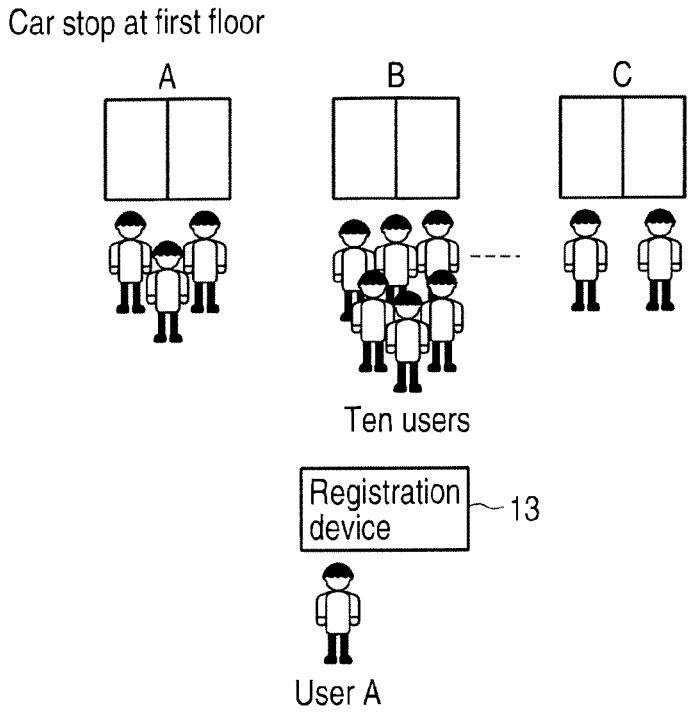
FIG. 8 is a diagram illustrating a waiting state of users at the car stop of the first floor of the building in the first embodiment.
Figure 9:
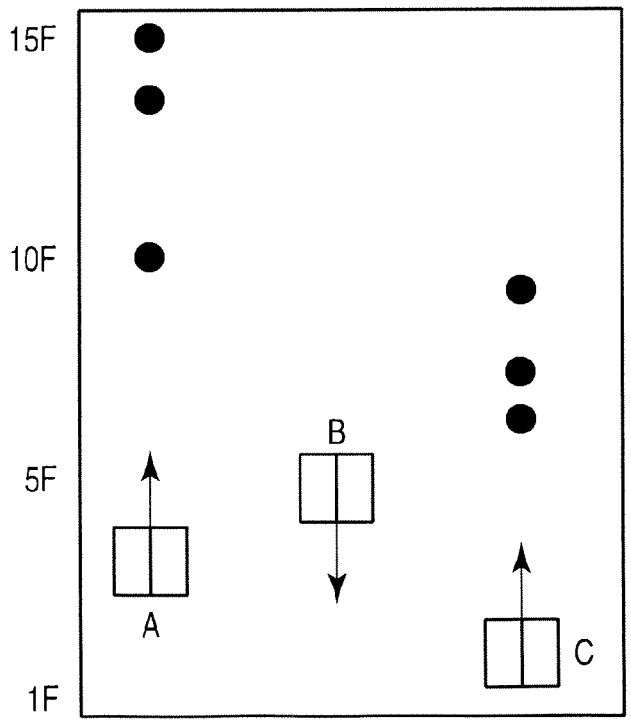
FIG. 9 is a diagram illustrating traveling states of the cars (cars A, B, and C) in the building in the first embodiment.

FIG. 8 and FIG. 9 illustrate the case where three elevators (cars) are installed in a fifteen-story building. Specifically, FIG. 8 illustrates a waiting state of users at the car stop of the first floor, and FIG. 9 illustrates traveling states of the cars (cars A, B, and C). In FIG. 9, black circles indicate floors at which the cars are stopping.

Suppose the following:

Car A:

Traveling around the 3rd floor in the upward direction (stopping at the 10th, 14th, and 15th floors); and a car stop call at the first floor has been assigned, and three users are waiting at the first floor (their target floors are the 10th and 13th floors).

Car B:

Traveling around the 5th floor in the upward direction (stopping at the 1st floor); and a car stop call at the first floor has been assigned, and ten users are waiting at the first floor (their target floors are the 2nd, 3rd, and 6th floors).

Car C:

Traveling around the 1st floor in the upward direction (stopping at the 6th, 7th, and 9th floors); and a car stop call at the first floor has been assigned, and two users are waiting at the first floor (their target floors are the 8th and 9th floors).

In such a situation, the flow of processing performed when user A registers 5th floor as the target floor at the car stop destination floor registration device 13 provided at the first floor. Suppose that the capacity of each elevator is set at 700 kg.

Figure 10:
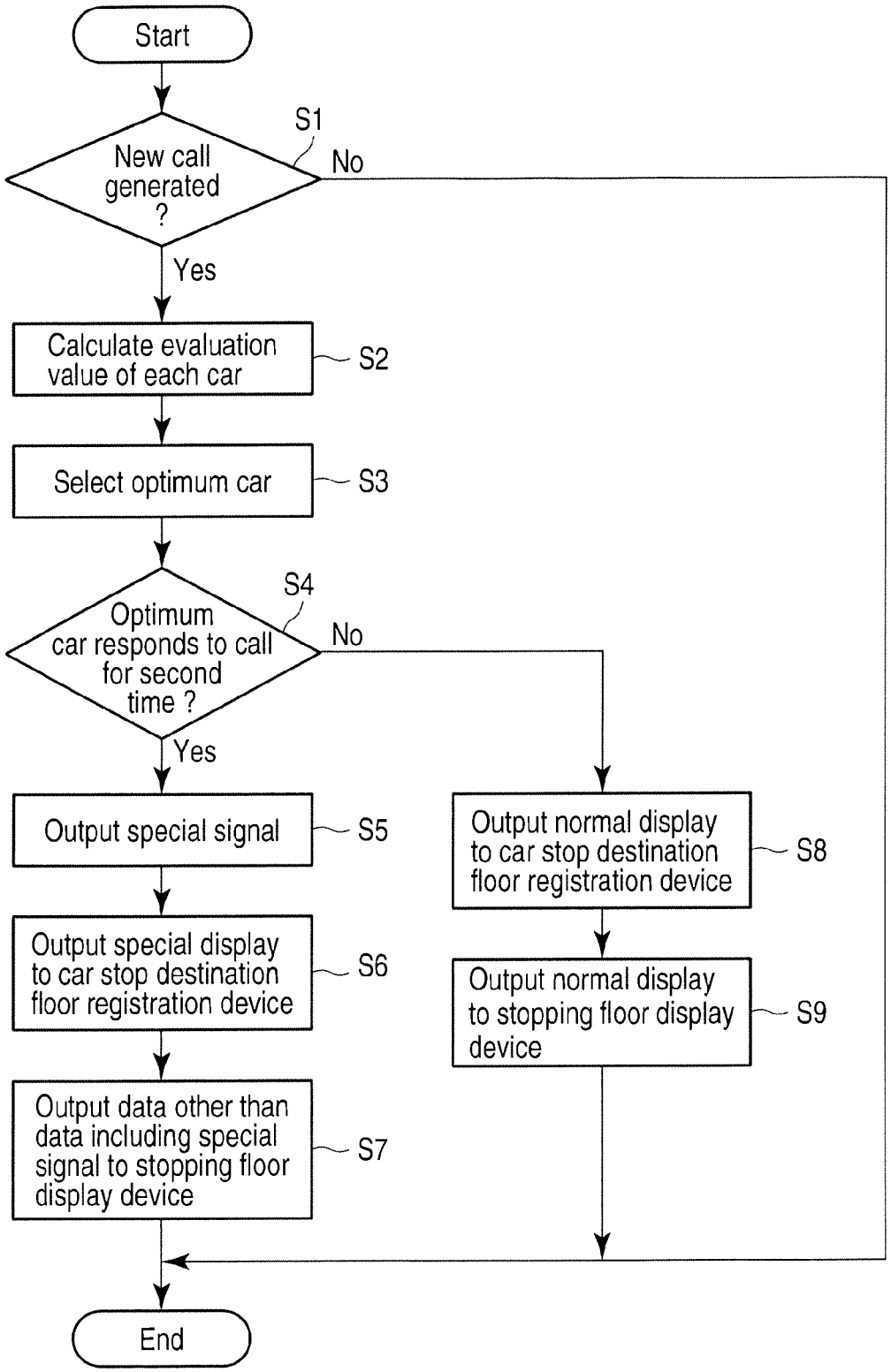
FIG. 10 is a flowchart illustrating assignment processing performed for a new car stop call by a group management control unit in the first embodiment.

FIG. 10 is a flowchart illustrating assignment processing performed by the group management control unit 20 for a new car stop call.

When user A registers 5th floor as the target floor at the car stop destination floor registration device 13 provided at the first floor, the call information item is registered in the registration control unit 21, and it is determined that a new car stop call is generated (Step S1). When it is determined that a new car stop call is generated (Yes of Step S1), the assignment control unit 23 calculates an evaluated value of each car based on calculation results of the response time calculation unit 22 (Step S2).

At this step, the evaluated value is calculated by using an evaluated value calculation equation as illustrated in Equation (1), in consideration of the service time and the degree of influence on other users.

$$\text{Evaluated value } (E)=\alpha 1\times\text{Service time}+\alpha 2\times\text{Degree of influence on other users} \quad (1)$$

In the above Equation (1), the service time is calculated by using the first response time or the second response time, based on the boarding possibility determination result.

The symbols $\alpha 1$ and $\alpha 2$ denote weighting coefficients. For example, $\alpha 1$ is set to 0.7, and $\alpha 2$ is set to 0.3.

The weighting coefficients $\alpha 1$ and $\alpha 2$ can be set to desired values. For example, when greater importance should be attached to the degree of influence on other users than the service time, the coefficients should be set such that the condition "$\alpha 1<\alpha 2$" is satisfied within the range "$\alpha 1+\alpha 2=1$". As examples of a specific setting method, a maintenance worker may connect a terminal device (not shown) to the group management control unit 20 and set the coefficients by predetermined operation, or the maintenance worker may set the coefficients from a monitoring center (not shown) through a communication network. The degree of influence on other users is indicated by the time by which the service time is delayed, by additionally assigning a new car stop call to the car.

<Evaluated Value of Car A>

The evaluated value of car A is calculated as follows.

Figure 11:
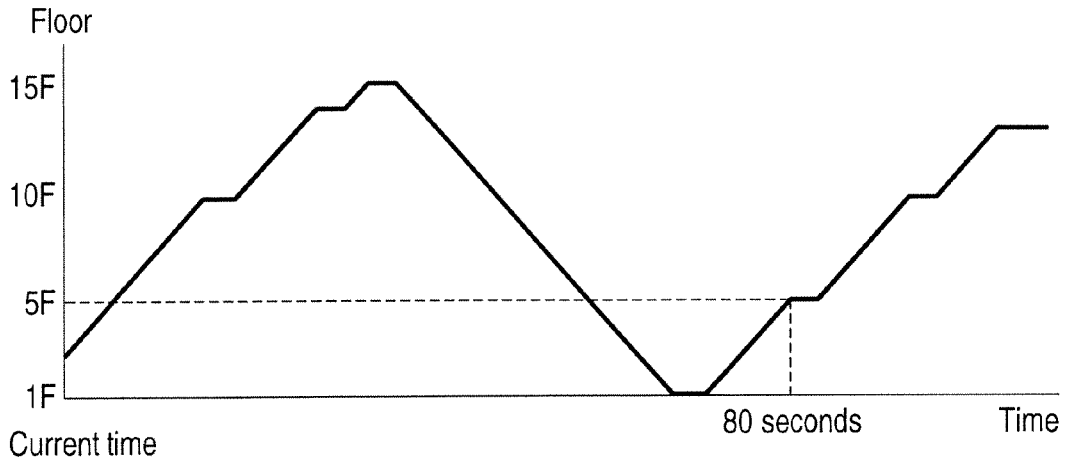
FIG. 11 is a diagram illustrating an example of an expected traveling curve of car A in the first embodiment (in the case where the car stop call is assigned to car A)

FIG. 11 illustrates an expected traveling curve in the case where user A registers the 5th floor as the target floor by the car stop destination floor registration device 13 provided at the first floor, and the new car stop call for the 5th floor is assigned to car A. By the expected traveling curve, the service time for the new car stop call is calculated as 80 seconds.

By assigning the new car stop call to car A, each service time of two users whose target floor is the 10th floor and one user whose target floor is the 13th floor is delayed by 5 seconds.

Target floor 10th floor (2 people): Delay of 5 seconds×2 people=10 seconds

Target floor 13th floor (1 person): Delay of 5 seconds×1 person=5 seconds

Therefore, the degree of influence on other users is calculated as 15 seconds (10 seconds+5 seconds).

Therefore, the evaluated value ($E_A$) of car A is:

$$E_A=0.7\times 80+0.3\times 15=60.5$$

<Evaluated Value of Car B>

The evaluated value of car B is calculated as follows.

Figure 12:
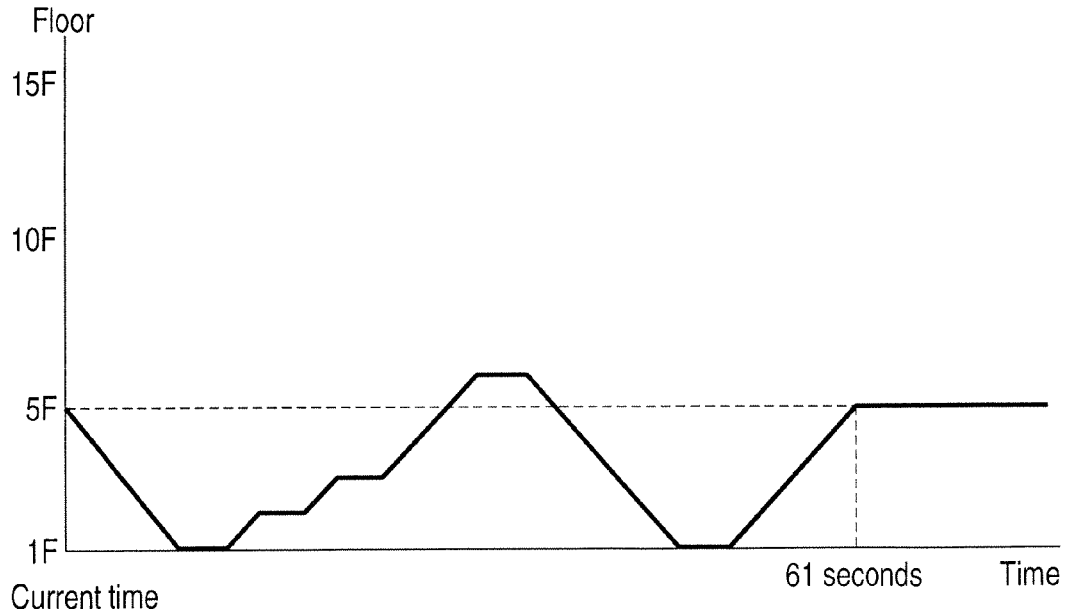
FIG. 12 is a diagram illustrating an example of an expected traveling curve of car B in the first embodiment (in the case where the car stop call is assigned to car B)

When a new car stop call of user A is assigned to car B, the expected load at the time of starting from the first floor is calculated by the car load calculation unit 24 as "65 kg×11 people=715 kg". Since the preset capacity of the car is 700 kg, the boarding possibility determination unit 25 determines that user A cannot get on the car. In receipt of this result, the response time calculation unit 22 prepares an expected traveling curve on the assumption that user A gets on car B at the second response. FIG. 12 illustrates the expected traveling curve prepared. Based on the expected traveling curve, the service time for the new car stop call is calculated as 61 seconds.

Since car B responds to the new car stop call after it has responded to all the calls, there are no influenced users, and the degree of influence on other users is 0.

Therefore, the evaluated value ($E_B$) of car B is:

$$E_B=0.7\times 61+0.3\times 0=42.7$$

<Evaluated Value of Car C>

The evaluated value of car C is calculated as follows.

Figure 13:
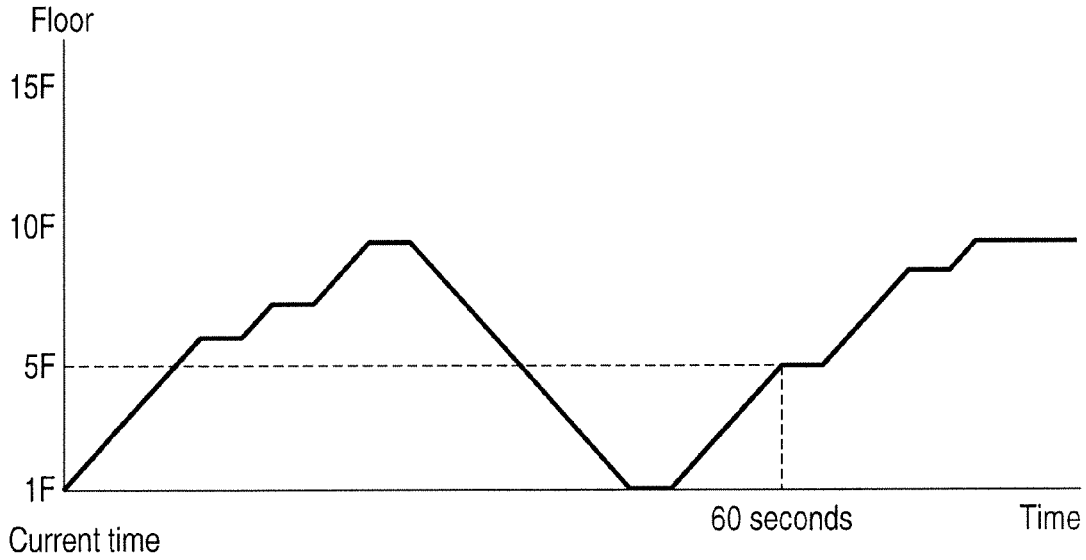
FIG. 13 is a diagram illustrating an example of an expected traveling curve of car C in the first embodiment (in the case where the car stop call is assigned to car C)

FIG. 13 illustrates an expected traveling curve in the case where the new car stop call of user A is assigned to car C. Based on the expected traveling curve, the service time for the new car stop call is calculated as 60 seconds.

Since the new car stop call is assigned to car C, each of one user whose target floor is the 8th floor and one user whose target floor is the 9th floor is influenced by delay of 5 seconds.

Target floor 8th floor (1 person): Delay of 5 seconds×1 person=5 seconds

Target floor 9th floor (1 person): Delay of 5 seconds×1 person=5 seconds

Therefore, the degree of influence on other users is calculated as 10 seconds (5 seconds+5 seconds).

Therefore, the evaluated value ($E_C$) of car C is:

$$E_C=0.7\times 60+0.3\times 10=45$$

When the evaluated values of the cars are calculated as described above, the assignment control unit 23 selects the car whose evaluated value is the smallest as optimum car (Step S3). Generally, in evaluation function, the higher value is set on the object having the smaller evaluated value, and the lower value is set on the object having the larger evaluated value.

In the example of the above case, car B is selected as optimum car. In the case of selecting car B, user A can get on the car when car B arrives at the first floor for the second time in response to the new car stop call (Step S4), and thus the assignment control unit 23 outputs assigned car information indicating that car B is the assigned car, and a special signal indicating that the response is the second response (Step S5). The special signal includes information that indicates which car stop call of which floor the car responds to for the second time.

Figure 15:
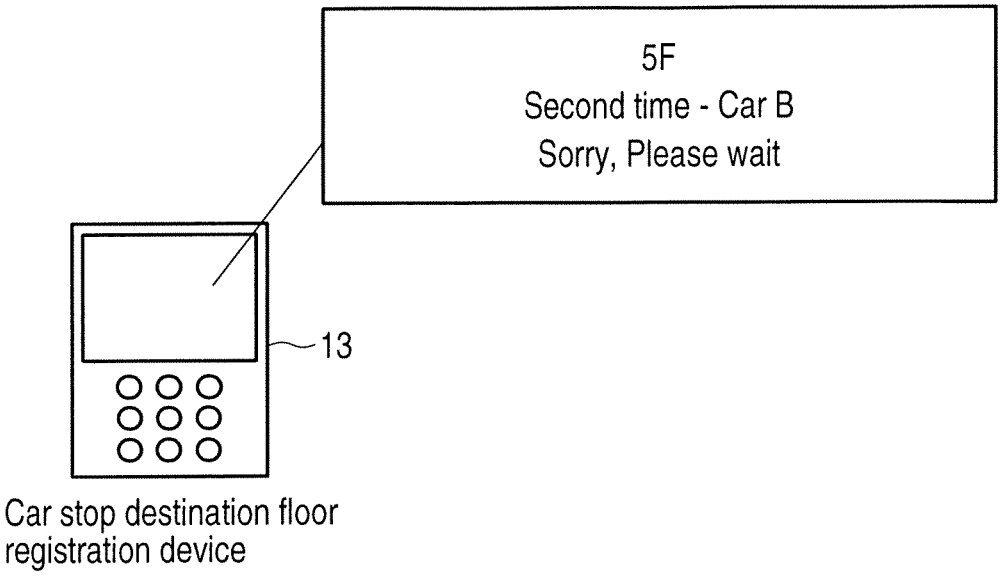
FIG. 15 is a diagram illustrating a display example of the car stop destination floor registration device when a special signal is output in the first embodiment.

When the registration control unit 21 receives the special signal, the registration control unit 21 sets information "ON" which indicates signal reception in the item of special signal corresponding to the call of "registration floor=1st floor, target floor=5th floor, assigned car=B", in the database 21*a* illustrated in FIG. 14. Then, the registration control unit 21 outputs special message information together with assigned car information, to the car stop destination floor registration device 13 provided at the first floor which is the registration floor (Step S6). Thereby, as illustrated in FIG. 15, the car stop destination floor registration device 13 provided at the first floor performs special display, and guides user A not to get on car B which responds to the call for the first time, but get on car B which responds to the call for the second time. The device 13 may notify the user of the above by not only the display but also announcement or the like.

Figure 16:
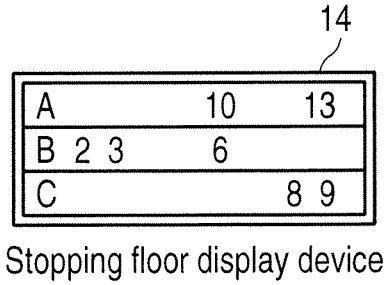
FIG. 16 is a diagram illustrating a display example of the stopping floor display device when a special signal is output in the first embodiment.

In addition, the registration control unit 21 outputs, to the stopping floor display device 14 provided at the first floor, data items other than fifth floor, for which the special signal is set, among data items (2nd, 3rd, 5th, 6th floors) of "registration floor=1st floor, and assigned car=car B" stored in the database 21*a* (Step S7). Thereby, as illustrated in FIG. 16, the stopping floor display device 14 provided at the first floor displays the 2nd, 3rd, and 6th floors other than the 5th floor as the stopping floors of car B. This prevents user A from erroneously getting on car B at the first response.

On the other hand, for example, when car A or C is selected as optimum car, user A can get on the car at the first response (No of Step S4). In this case, the assigned car information is output to the car stop destination floor registration device 13 provided at the first floor which is the registration floor, and normal display is performed (Step S8). Specifically, the device 13 at the first floor performs display showing that user A can get on car A or C.

In addition, the stopping floor display device 14 provided at the first floor performs normal display of the stopping floors including the 5th floor.

The following is explanation of processing operation performed at the first response of the assigned car.

Figure 17:
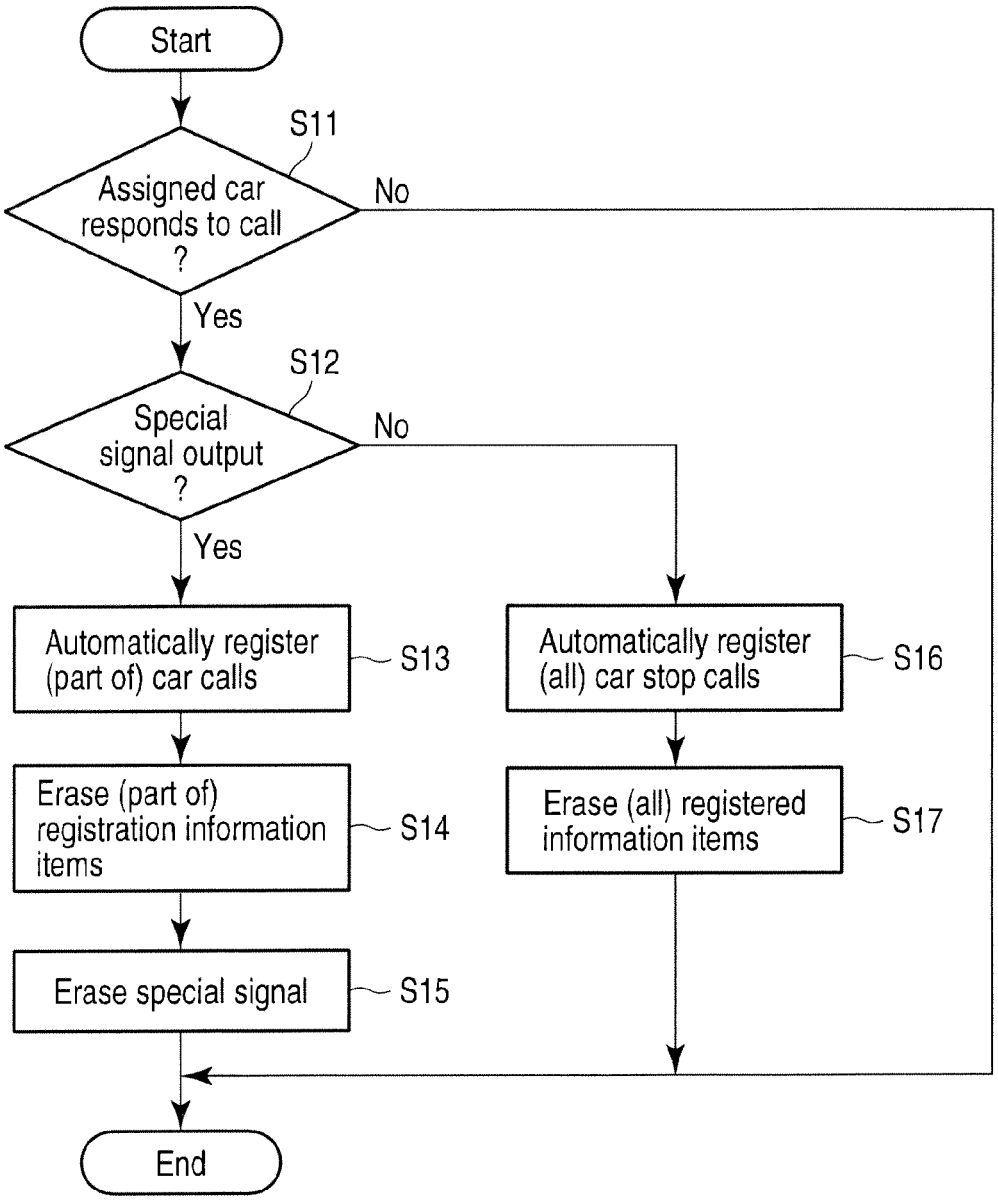
FIG. 17 is a flowchart illustrating processing operation performed by the group management control unit at the first response in the first embodiment.

FIG. 17 is a flowchart illustrating processing operation performed by the group management control unit 20 at the first response of the car. Suppose that car B serving as the assigned car responds to the call of the first floor which is the registration floor of the car stop call, in the case illustrated in FIG. 8 and FIG. 9.

When car B being the assigned car responds to the call of the first floor (Step S11), the registration control unit 21 checks whether a special signal is output from the assignment control unit 23 (Step S12). When a special signal is output (Yes of Step S12), the registration control unit 21 outputs, to the car control unit 11 of car B, data items other than the fifth floor for which the special signal is set, among data items (2nd, 3rd, 5th, 6th floors) of "registration floor=1st floor, and assigned car=car B" stored in the database 21*a* (Step S13). Thereby, the car calls for the 2nd, 3rd, and 6th floors other than the 5th floor are automatically registered in car B.

Thereafter, the registration control unit 21 erases only data items for which no special signal is set, among the data items of "registration floor=1st floor, and assigned car=car B" stored in the database 21*a* (Step S14). FIG. 18 illustrates the state of the database 21*a* after Step 14.

In addition, when the assigned car arrives at the registration floor in response to the call, the assignment control unit 23 stops output of the special signal. Thereby, the registration control unit 21 resets the special signal item corresponding to the call of "registration floor=1st floor, target floor=5th floor, assigned car=B", and erases the special signal (Step S15).

Figure 20:
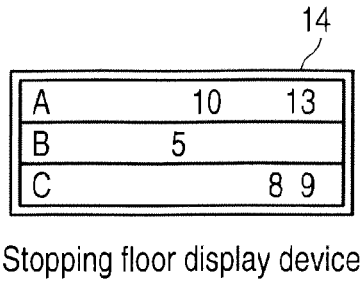
FIG. 20 is a diagram illustrating a display example of the stopping floor display device when no special signal is output from an assignment control unit in the first embodiment.

FIG. 19 illustrates the state of the database 21*a* after Step S15. The data of the call of "registration floor=1st floor, target floor=5th floor, assigned car=B" becomes normal data. Therefore, the stopping floor display device 14 provided at the first floor displays the stopping floors of car B, including the 5th floor, as illustrated in FIG. 20. In addition, when car B arrives at the first floor in response to the call, the car stop call for the 5th floor is automatically registered.

On the other hand, at the above Step S12, when no special signal is output from the assignment control unit 23, all the data items (2nd, 3rd, 5th and 6th floors) of the calls of "registration floor=1st floor, assigned car=B" stored in the database 21*a* are output to the car control unit 11 of car B, and car stop calls for the 2nd, 3rd, 5th and 6th floors are automatically stored in car B (Step S16). Then, all the data items of the calls of "registration floor=1st floor, assigned car=B" are erased from the database 21*a* (Step S17).

As described above, the car load is calculated for each car, and the optimum car is selected in consideration of the boarding possibility for a new car stop call. In the selection, the optimum car is selected from not only cars of the first response but also cars of the second response, and thereby it is possible to efficiently carry the users, preventing confusing the users, even when the car stop is crowded.

In addition, when the car of the second response is selected for a new car stop call, the car stop destination floor registration device 13 displays which car of which time the user should get on, and the stopping floor display device 14 displays the stopping floors in accordance with the assignment, and thus discomfort of the users can be reduced.

Second Embodiment

A second embodiment will be explained hereinafter.

When it is determined that the user gets on the car of the second response, the user has to wait for the car until the car travels around and returns to the floor, and thus the waiting time is long and the user sometimes feels uncomfortable. Therefore, the second embodiment has the feature that the waiting time for the car of the second response is displayed, and the registered car stop call can be cancelled.

Since the basic structure of the apparatus is the same as that illustrated in FIG. 1 in the above first embodiment, the processing operation of the second embodiment will be explained hereinafter.

Figure 21:
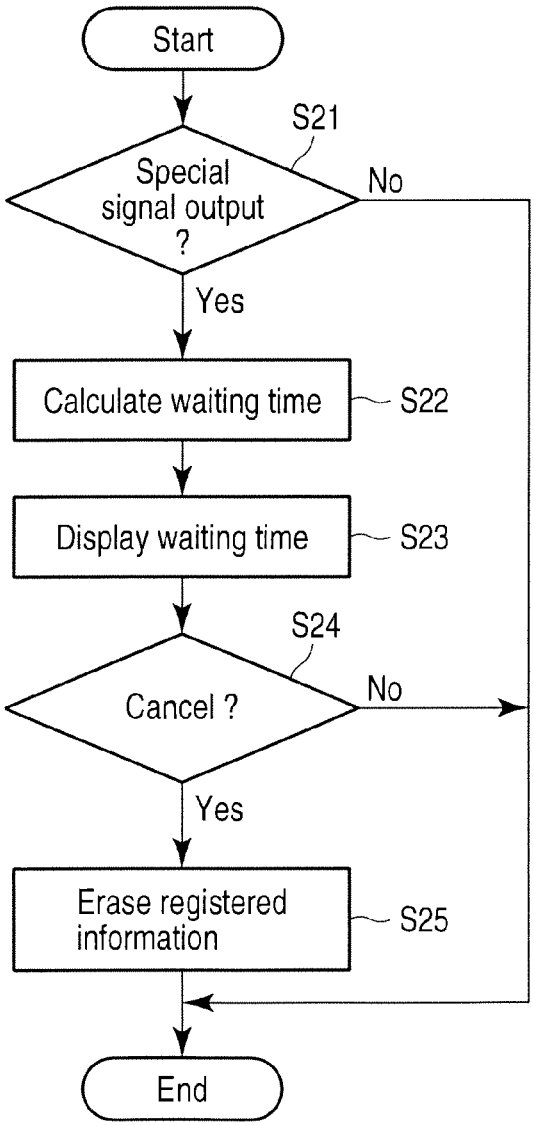
FIG. 21 is a flowchart illustrating processing operation performed by a group management control unit at the second response in a second embodiment.

FIG. 21 is a flowchart illustrating processing operation performed by a group management control unit 20 for the second response in the second embodiment. Suppose that car B serving as the assigned car responds to the call of the first floor which is the registration floor of the car stop call, in the case illustrated in FIG. 8 and FIG. 9.

Figure 22:
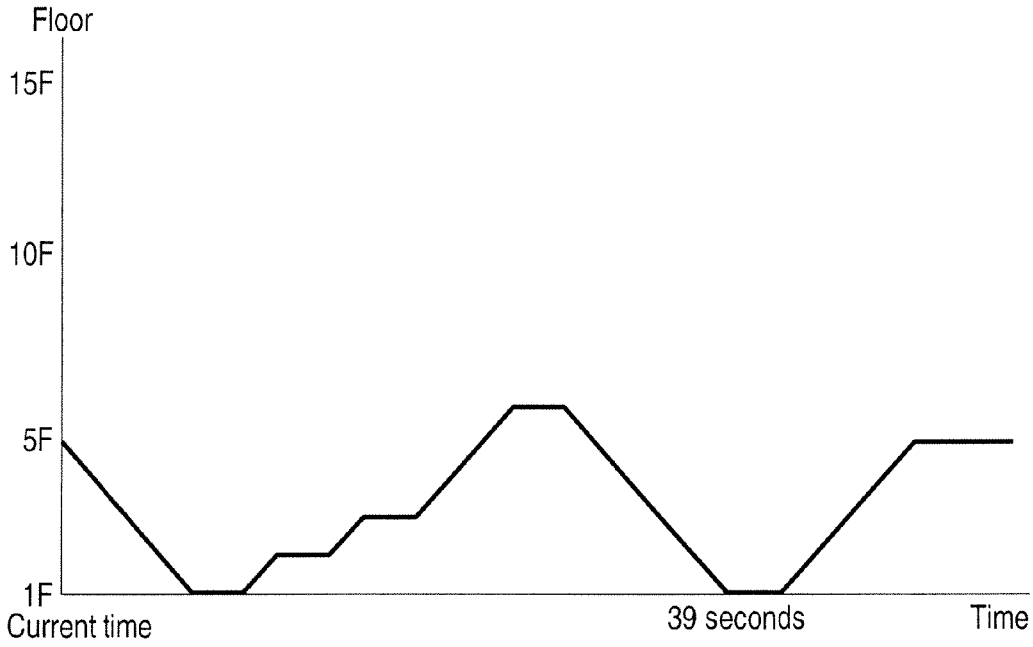
FIG. 22 is a diagram illustrating an example of an expected traveling curve of car B in the second embodiment.

When a response time calculation unit 22 receives a special signal from an assignment control unit 23 (Yes of Step S21), the response time calculation unit 22 calculates a waiting time for a newly registered car stop call (Step S22). In this calculation, the response time calculation unit 22 calculates the time required since the car stop call is registered until car B arrives at the first floor for the second time (the time required until user A gets on car B). FIG. 22 illustrates an expected traveling curve of car B. In this example, the waiting time is calculated as 39 seconds.

A registration control unit 21 registers the waiting time calculated by the response time calculation unit 22 in a database 21*a*, and outputs the waiting time to a car stop destination floor registration device 13 provided at the first floor to display the waiting time (Step S23). FIG. 23 illustrates the state of the database 21*a* after the waiting time is registered, and FIG. 24 illustrates an example of display of the waiting time by the car stop destination floor registration device 13.

Figures 24, 25:
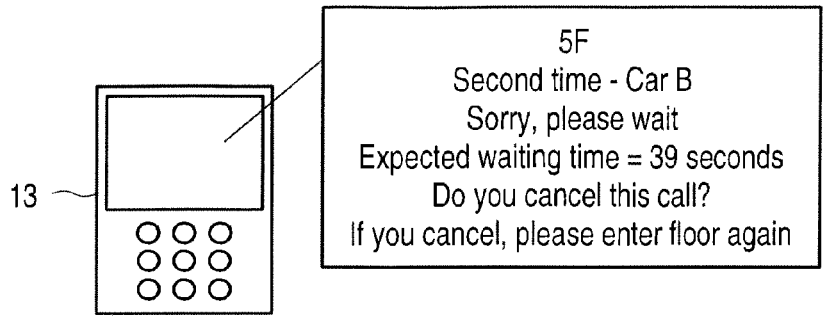
FIG. 24 is a diagram illustrating a display example of a car stop destination floor registration device in the second embodiment.
FIG. 25 is a diagram illustrating a state of the database provided in the registration control unit after a call is erased in the second embodiment.

As illustrated in FIG. 24, when the waiting time is displayed on the car stop destination floor registration device 13, the car stop destination floor registration device 13 also displays a message including a message of asking the user whether the user wishes to cancel the call or not, and the method of canceling the call. Voice announcement may be used together with the message display.

According to the above structure, it is possible to notify the user, who has registered a call, of the waiting time required until car B arrives at the registration floor, and check whether the user cancels the call or not. Although the method of canceling the call is inputting the same target floor (5th floor) again in the above example, the method may be pressing a cancel button which is provided in the car stop destination floor registration device 13.

When user A cancels the call (Yes of Step S24), the registration control unit 21 erases the corresponding car stop call information item in the database 21*a* (Step S25). FIG. 25 illustrates the state of the database 21*a* after the call is erased.

As described above, when it is determined that the user gets on the car of the second response, the waiting time is displayed in advance, and thus discomfort of the user can be reduced. In addition, it is checked whether the user wishes to cancel the call or not, and the corresponding car stop call information item is erased when the user cancels the call. Thereby, it is possible to prevent unnecessary response by the elevator, and prevent deterioration in group management performance.

Although it is explained in the above embodiments that the user gets on the car of the second response when the user cannot get on the car of the first response, it is possible to adopt the structure of determining the boarding possibility including the second response and later responses, and notify the user of the result thereof.

In addition, the present invention is not limited to a group management system including a plurality of cars, but is also applicable to a "one-car system" which controls operation of a car.

In the case of applying the present invention to a one-car system, when the user registers a car stop call including a destination floor at a car stop, there is no processing of selecting an optimum car from a plurality of cars, and it is determined for one car whether the user get on the car of the first response, based on a car load calculation result.

When the user cannot get on the car of the first response, the apparatus performs display indicating that the user should get on the car at the second response, and thereby it is possible to prevent confusion at the car stop and efficiently carry the users. In addition, it is possible to reduce discomfort of the users, by performing display of the waiting time and cancel of the car stop call as explained in the second embodiment. Besides, the boarding possibility may be determined not only for the second response but also for the third and following responses.

In short, the present invention is not limited to the above embodiments, but can be carried out by modifying constituent elements thereof within a range not departing from the gist. In addition, various inventions can be made by proper combinations of constituent elements disclosed in the above embodiments. For example, some constituent elements may be deleted from all the constituent elements disclosed in the embodiment. In addition, constituent elements of different embodiments may be used in combination.

According to an elevator control apparatus of at least one embodiment described above, it is possible to prevent the users' confusion and efficiently carry the users even when the car stop is crowded, in an elevator which can register car stop calls including destination floors of the users by using a car stop destination floor registration device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An elevator control apparatus equipped with car stop destination floor registration devices that are provided at car stops of floors and are configured to register destination floors of users and to assign a car stop call of a user including a destination floor to be registered by operation of one of the car stop destination floor registration devices to an optimum car among a plurality of cars, the apparatus comprising:

a response time calculation unit configured to calculate a response time of each car of the plurality of cars required when the car stop call is assigned to the car;

an assignment control unit configured to select the optimum car from the plurality of cars and to assign the car stop call to the optimum car, based on the response time of each car of the plurality of cars calculated by the response time calculation unit;

a car load calculation unit configured to calculate a load value of each car of the plurality of cars at a time when each car of the plurality of cars starts from a registration floor of the car stop call after responding to the call;

a boarding possibility determination unit configured to determine for each car of the plurality of cars whether the user can board the car by comparing the load value calculated by the car load calculation unit with a preset capacity value; and a registration control unit configured to control the response time calculation unit and the assignment control unit to assign the car stop call, including a second response and later responses to the registration floor of the car stop call, based on a determination result of the boarding possibility determination unit.

2. The elevator control apparatus according to claim 1, wherein the response time calculation unit calculates time required, for a car of the plurality of cars that the boarding possibility determination unit determines the user cannot board until the car responds to the registration floor of the car stop call for a second time or a later time.

3. The elevator control apparatus according to claim 1, wherein the assignment control unit is configured to calculate for each car of the plurality of cars, an evaluated value which indicates an optimum for the car stop call by adding a degree of influence on other users until the car responds to the registration floor of the car stop call to the response time calculated by the response time calculation unit.

4. The elevator control apparatus according to claim 1, wherein the assignment control unit is configured to output a special signal indicating that the car of the plurality of cars to which the car stop call is assigned responds to the call for the second time or the later time, until the car finishes a first response, when the car responds to the call for the second time or the later time.

5. The elevator control apparatus according to claim 4, wherein the car stop destination floor registration device displays a car of the plurality of cars to which the car stop call is assigned by the assignment control unit, and displays that the user can board the car of a second response or of a later response when the special signal is output from the assignment control unit.

6. The elevator control apparatus according to claim 4, further comprising stopping floor display devices that are provided at the car stops of the floors and which display stopping floors of the plurality of cars in response to a car stop call assignment output by the assignment control unit, wherein the stopping floor display devices do not display a destination floor which is indicated by the special signal and for which the assigned car starts at the second response or later, when the special signal is output from the assignment control unit.

7. The elevator control apparatus according to claim 5, wherein:

the response time calculation unit is configured to calculate a waiting time required until the car to which the car stop call is assigned responds to the registration floor of the car stop call, when the car responds to the call for the second time or later, and the car stop destination floor registration devices perform display of information including the waiting time calculated by the response time calculation unit.

8. The elevator control apparatus according to claim 4, wherein the registration control unit is configured to erase registration information of the car stop call including a destination floor, when the registration control unit receives a request of canceling the destination floor from one of the car stop destination floor registration devices, while the special signal is output from the assignment control unit.

9. An elevator control apparatus equipped with car stop destination floor registration devices that are provided at car stops of floors and can register destination floors of users, and configured to assign a car stop call of a user including a destination floor to be registered by operation of one of the car stop destination floor registration devices to a car, comprising:

an assignment control unit configured to assign the car stop call to the car;

a car load calculation unit configured to calculate a load value of the car at a time when the car starts from a registration floor of the car stop call after responding to the call;

a boarding possibility determination unit configured to determine whether the user can board the car or not, by comparing the load value calculated by the car load calculation unit with a preset capacity value; and a registration control unit configured to control the assignment control unit to assign the car stop call, including a second response and later responses to the registration floor of the car stop call, based on a determination result of the boarding possibility determination unit.

* * * * *